United States Patent [19]

Kokubu et al.

[11] Patent Number: 4,555,743

[45] Date of Patent: Nov. 26, 1985

[54] TIMER CIRCUIT

[75] Inventors: Sadao Kokubu; Masatoshi Hirano; Takao Sakakibara, all of Aichi, Japan

[73] Assignee: Kabushiki Kaisha Tokai Rika Denki Seisakusho, Aichi, Japan

[21] Appl. No.: 516,363

[22] Filed: Jul. 22, 1983

[30] Foreign Application Priority Data

Jul. 27, 1982 [JP] Japan ..... 57-112865[U]

[51] Int. Cl.[4] ..... H01H 47/18

[52] U.S. Cl. ..... 361/196; 219/203; 219/492

[58] Field of Search ..... 361/196; 219/203, 492, 219/493; 307/600, 605, 590, 592

[56] References Cited

U.S. PATENT DOCUMENTS 3,858,027 12/1974 Phillips ..... 361/196 X 3,894,247 7/1975 DeJong ..... 307/592

3,898,423 8/1975 Taylor et al. ..... 219/203

3,944,893 3/1976 Hayden ..... 219/203 X 3,973,140 8/1976 Phillips ..... 219/203 X 4,424,438 1/1984 Antelman et al. ..... 361/191 X

*Primary Examiner*—Reinhard J. Eisenzopf

[57] ABSTRACT

A timer circuit suitable for operating, for a required period of time, the windshield defrosting heater in an automobile, comprises a switch operative only in one direction, such as a momentary unidirection switch, a timer which starts timing operation after a lapse of a predetermined time, and a flip-flop circuit or the like. The switch allows setting and cancelling for timing operation, whereby the operative characteristics are improved and the mechanical design is simplified. Moreover, the use of a flip-flop circuit reduces the occurrence of chattering.

1 Claim, 3 Drawing Figures

TIMER CIRCUIT

BACKGROUND OF THE INVENTION

The present invention relates to a timer circuit suitable for operating, for example, the rear windshield defrosting and defogging heater in automobiles, for a required period of time.

In this field, the conventional timer is operated by separate signals produced by a switch in opposite directions, resulting in possible erroneous operation by the car driver. Since transistors of the circuit enter the active region immediately before the timer circuit completes its operation, a supply voltage to relay is caused to fall gradually. Then, a chattering of the relay contacts results.

SUMMARY OF THE INVENTION

Accordingly, it is an object of the present invention to provide a timer circuit which provides satisfactory operative characteristics and is tolerant of the occurrence of chattering.

According to the present invention, as will be described hereinafter, the combination of a single unidirectional switch for performing setting and cancelling operations with a flip-flop circuit improves the operative characteristics with a simple mechanical structure and reduces the occurence of chattering produced by the relay contacts.

DETAILED DESCRIPTION OF THE EMBODIMENTS

A conventional timer circuit and the present invention will now be described by way of example with reference to the accompanying drawings.

Figure 1:
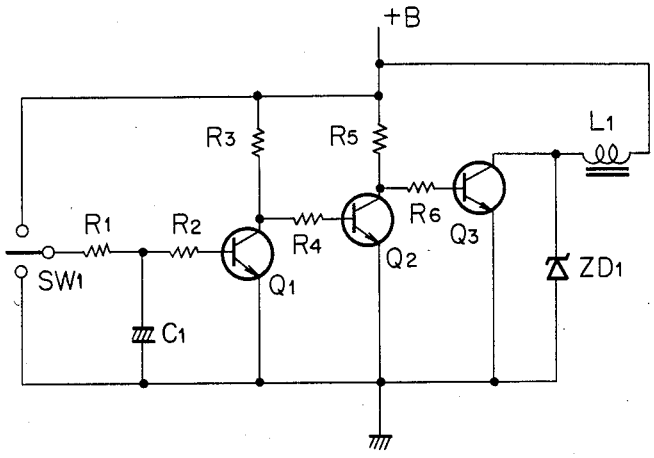
FIG 1 Prior Art
FIG. 1 is schematic diagram showing the conventional timer circuit.

In FIG. 1 showing schematically the conventional timer circuit, SW1 is a bidirectional momentary switch, which conducts its moving contact to a power voltage +B or the ground voltage. The output of the switch SW1 provided at the moving contact is fed through a resistor R1 to a timeconstant circuit made up of a capacitor C1 and a resistor R2, and also fed to the base of a transistor Q1 whose emitter is grounded and where collector is connected through a resistor R3 to the power source +B. A transistor Q2 has its emitter grounded, collector connected through a resistor R5 to the power source +B, and base connected through a resistor R4 to the collector of the transistor Q1. A transistor Q3 has its base connected through a resistor R6 to the collector of the transistor Q2, emitter gounded, and collector connected through a relay L1 to the power source +B. Connected between the collector and emitter of the transistor Q3 is a zener diode ZD1.

The operation of the above circuit arrangement is as follows. With the switch SW1 set to the neutral position as shown in the figure, the transistor Q1 is non-conductive, transistor Q2 is conductive, and transistor Q3 is non-conductive, and thus the relay L1 is kept deenergized. When the switch SW1 is operated in the upward direction in the drawing, the capacitor C1 is charged through the resistor R1, causing the transistor Q1 to become conductive, transistor Q2 non-conductive, and transistor Q3 conductive, and then the relay L1 is energized. In consequence, a heater circuit (not shown) for example, will operate.

When the switch SW1 is released, it returns automatically to the neutral position, while the transistor Q1 (and transistor Q3 accordingly) remains conductive for the duration of the time constant determined by the resistor R2 and capacitor C1, in which the capacitor C1 is discharged through the resistor R2 and the base-emitter junction of the transistor Q1. Upon expiration of the time, the transistor Q1 becomes non-conductive, transistor Q2 becomes conductive, and transistor Q3 becomes non-conductive.

If, on the other hand, the switch SW1 is operated in the downward direction in the drawing during the discharging period, the capacitor C1 is discharged sharply through the resistor R1, causing the transistor Q1 to become non-conductive transistor Q2 conductive, and transistor Q3 non-conductive.

In the foregoing conventional timer circuit, the timer is set and cancelled by separate signals produced by the switch operating in opposite directions, resulting possibly in an erroneous operation by the car driver. Moreover, the transistors Q1–Q3 enter the active region immediately before the timer operation completes, causing the supply voltage to the relay L1 to fall, that tends to cause a chattering of relay contacts due to vibration.

Figure 2:
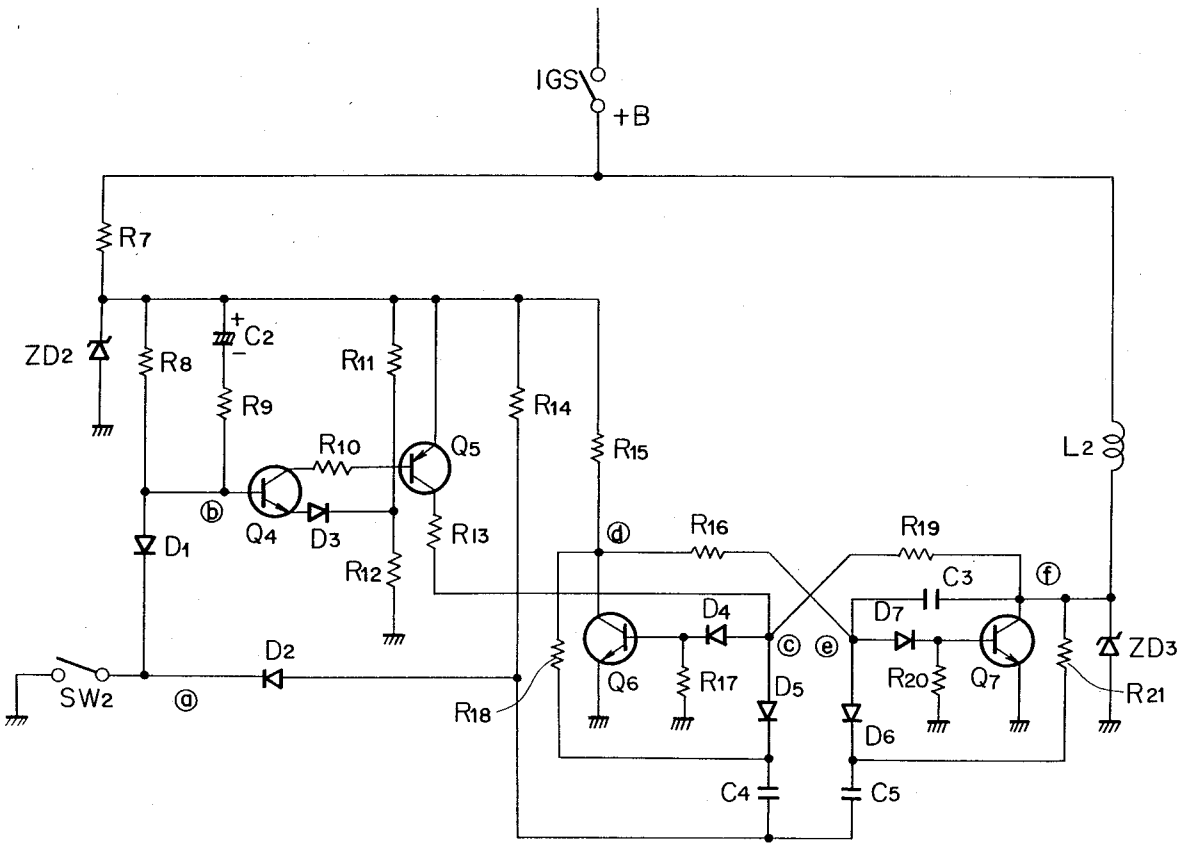
FIG. 2 is a schematic diagram showing the timer circuit according to the present invention.

FIG. 2 shows schematically the timer circuit according to the present invention. A power source +B is applied through an ignition switch IGS across a serial connection of a relay L2 and a zener diode ZD3, and, in parallel, across a serial connection of a resistor R7 and zener diode ZD2, so that a constant voltage Vo is obtained at the node of the resistor R7 and zener diode ZD2. The base of a transistor Q4 is supplied with the voltage Vo through a parallel circuit made up of a resistor R8 and a serial connection of a capacitor C2 and a resistor R9, and grounded through a diode D1 and a unidirectional momentary switch SW2. The transistor Q4 has its emitter connected through a diode D3 to the node of resistors R11 and R12 for dividing the voltage Vo, and its collector connected through a resistor R10 to the base of a transistor Q5 whose emitter is supplied with the voltage Vo. The transistor Q5 has its collector connected through a resistor R13 and a diode D4 to the base of a transistor Q6, which has its base grounded through a resistor R17, emitter grounded directly, and collector supplied with the voltage Vo through a resistor R15. A diode D5 has its anode connected to the anode of the diode D4, and its cathode connected through a resistor R18 to the collector of a transistor Q6 and to one end of a capacitor C4. The capacitor C4 has another end connected to receive the voltage Vo through a resistor R14 and grounded through a diode D2 and the switch SW2. The collector of the transistor Q6 is connected through a resistor R16 and a diode D7 to the base of a transistor Q7. The diode D7 has its anode connected through a diode D6 and a capacitor C5 to the node of the resistor R14 and diode D2. The transistor Q7 has its emitter grounded directly, base grounded through a resistor R20, and collector connected to the node of the diodes D4 and D5 through a resistor R19, also to the node of the diodes D6 and D7 through a capacitor C3, and to the node of the diode D6 and capacitor C5 through a resistor R21. The transistors Q6 and Q7, in conjunction with the resistors R16–R21, capacitors C3–C5, and diodes D4–D7, constitute a bistable flip-flop as a state holding circuit having two stable states.

Figure 3:
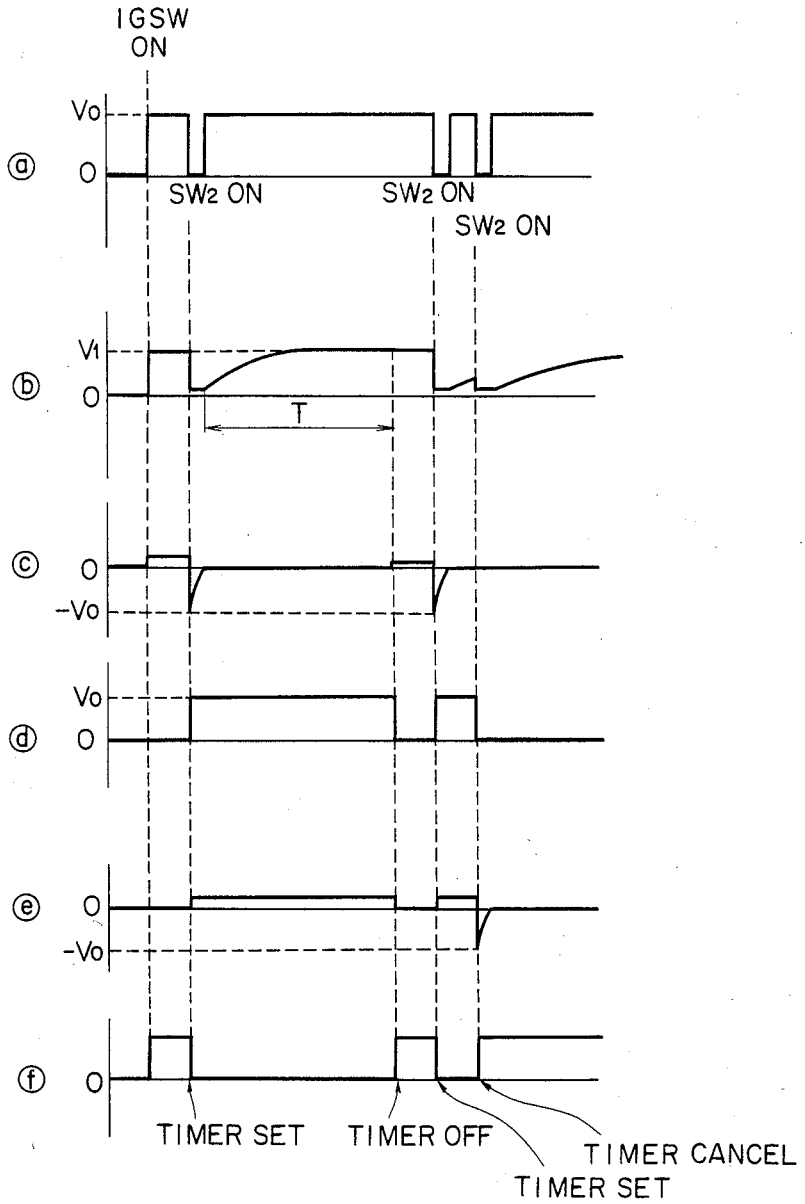
FIG. 3 is a timing chart showing the operation of the inventive circuit arrangement shown in FIG. 2.

The following describes the operation of the above circuit arrangement with reference to FIG. 3. When the ignition switch IGS is turned on, the voltage Vo is supplied through the resistor R8 to the base of the transistor Q4, causing the transistors Q4, Q5 and Q6 to be conductive, and the transistor Q7 non-conductive. The relay L2 is kept deenergized. At this time, the emitter voltage $V_{E4}$ of the transistor Q4 is expressed as follows.

$$V_{E4}=Vo\cdot R12/(R11+R12)+V_{D3}$$

where $V_{D3}$ is the forward voltage drop across the diode D3. The base voltage V1 of the transistor Q4 is expressed, on the assumption that $V_{BE4}=V_{D3}=V_{BE}$, as follows:

$$V_1=V_{E4}+V_{BE4}=Vo\cdot R12/(R11+R12)+2V_{BE}$$

Accordingly, the capacitor C2 is charged to the voltage Vo–V1. The capacitor C4 is charged to a voltage substantially equal to Vo through the resistors R14 and R18 and the collector-emitter path of the transistor Q6. For the capacitor C5, the transistor Q7 is non-conductive, and it has a voltage on both terminals substantially equal to $V_B$—$Vo_B$: power voltage).

Next, when the switch SW2 is operated once, one end of the capacitor C4 is grounded through the diode D2, causing another end to have a voltage of −Vo, and the voltage at point c becomes −Vo. [See FIG. 3*c*.] Then, the transistor Q6 is cut off and the transistor Q7 is made conductive. [See FIG. 3*d, f*.] In consequence, the relay L2 is energized and a switch (not shown) is turned on to activate a heater circuit and the like. At the same time, the capacitor C4 is discharged and, conversely, the capacitor C5 is charged through the resistors R14 and R21 and the collector-emitter path of the transistor Q7.

Furthermore, the diode D1 conducts the current through the switch SW2, causing the transistor Q4 to have a base voltage of $V_{D1}$, i.e., the forward voltage drop across the diode D1 substantially equal to $V_{BE}$. [See FIG. 3*a, b*.] In consequence, the transistor Q4 is cut off by being reverse-biased across the base-emitter junction ($V_{BE}<V1$), and then the transistor Q5 is also cut off. The capacitor C2 is further charged to the voltage Vo-$V_{BE}$.

When the switch SW2 is released back to the off state, the capacitor C2 is discharged through the resistors R8 and R9. [See FIG. 3*b*.] The base voltage of the transistor Q4 after the switch SW2 has been turned off is expressed in the following time function.

$$V(t)=(Vo-V_{BE})exp(-t/C2\cdot R3) \qquad (R8>>R9)$$

When the V(t) reaches V1 at a certain interval, the transistors Q4 and Q5 become conductive. The time interval T is expressed as follows.

$$T=-C2\cdot R8\cdot 1nV1/(Vo-V_{BE})$$

During the timing operation, the transistor Q4 stays cut-off, preventing the capacitor C2 from discharging through the base-emitter junction, thereby preventing the variation of operating time due to different amplification factors of individual transistors.

When the transistors Q4 and Q5 become conductive, the transistor Q6 becomes conductive by being supplied with the voltage Vo on its base through the diode D4, and the transistor Q7 is cut off. Then, the relay L2 is deenergized.

The zener diode ZD3 serves to release the reactive current produced by the relay L2, and the capacitor C3 serves to stabilize the flip-flop operation against noises included in the power voltage. The diode D1 prevents the capacitor C2 from discharging through the resistor R14, diode D2 and resistor R9 during the timing operation, and the diode D2 prevents the start of the timing operation which would take place when the capacitor C2 is charged through the resistor R9, diode D1, capacitor C4, resistor R18, and the collector-emitter path of the transistor Q6 when power is turned on and off repeatedly.

When the switch SW2 is operated again to cancel the timing operation before expiration of the above-mentioned interval T, one end of the capacitor C5 is grounded through the diode D2, causing another end of C5, i.e., point e, to have a voltage of −Vo. [See FIG. 3*e*.] Then, the transistor Q7 is cut off and the transistor Q6 becomes conductive. [See FIG. 3*d, f*.] The capacitor C2 is charged again to the voltage Vo-$V_{BE}$ and then starts discharging. Following the interval T, the transistors Q4 and Q5 become conductive, but the transistor Q6 is already conductive, and thus the transistors Q6 and Q7 maintain their states.

According to the present invention, as described above, a single unidirectional switch allows setting and cancelling for the timer circuit, whereby the operative characteristics are improved and the mechanical design is simplified. Moreover, the use of a flip-flop circuit reduces the occurence of chattering.

What is claimed is:

1. A rear window heater control circuit for an automobile, comprising:

a power source switch;

a first transistor connected to said power source switch so as to become conductive when said power source switch is turned on;

a timer circuit provided between said power source switch and said first transistor, said timer circuit including a capacitor and a resistor, said first transistor having a base connected to said timer circuit;

a second transistor arranged to become conductive when said first transistor becomes conductive;

a bistable circuit including a third transistor and a fourth transistor, said third transistor having a base receiving a bias current from said second transistor;

a normally open momentary switch having a first terminal which is grounded, and a second terminal connected to said power source switch;

a first diode connected between said power source switch and said normally open momentary switch, said first diode having an anode connected to said connection between the base of said first transistor and said time circuit;

a second diode having a cathode connected to said connection between said normally open momentary switch and said first diode and an anode connected to said power source switch;

a relay having a first end connected to said power source switch, and a second end connected to a collector of said fourth transistor, whereby conductivity of said third transistor and said fourth transistor is reversed to energize said relay upon closing of said normally open switch while said timer circuit starts discharging.

* * * * *